US006257579B1

(12) United States Patent
Horan

(10) Patent No.: US 6,257,579 B1
(45) Date of Patent: Jul. 10, 2001

(54) DICE GAME HAVING DEAD-EVEN ODDS

(76) Inventor: Michael J. Horan, 24 NE. 16th St., Pompano Beach, FL (US) 33062

( * ) Notice: Subject to any disclaimer, the term of this patent is extended or adjusted under 35 U.S.C. 154(b) by 0 days.

(21) Appl. No.: 09/244,379

(22) Filed: Feb. 4, 1999

Related U.S. Application Data

(60) Provisional application No. 60/073,645, filed on Feb. 4, 1998.

(51) Int. Cl.[7] ..... A63F 3/00
(52) U.S. Cl. ..... 273/274
(58) Field of Search ..... 273/274, 146

(56) References Cited

U.S. PATENT DOCUMENTS 4,346,900 * 8/1982 Lamlee ..... 273/274
5,513,850 * 5/1996 Vancura ..... 273/274
5,556,101 * 9/1996 Jabro ..... 273/274
5,775,696 * 7/1998 Sidlow et al. ..... 273/274

* cited by examiner

*Primary Examiner*—Benjamin H. Layno
(74) *Attorney, Agent, or Firm*—Sand & Sebolt; Daniel J. Long

(57) ABSTRACT

A method of playing a dice game between a first and second player. A first and second plurality of dice combinations having an equal probability of occurrence are defined. No combination in the second plurality of possible dice combinations is the same as any combination in the first plurality of possible dice combinations. The first player throws the dice to obtain an actual dice combination and wins if the first plurality of occurrences is the same as this actual combination. The second player wins if the actual dice combination matches the second plurality of occurrences. If neither player wins, the first player again throws the dice until one of the players wins.

10 Claims, 4 Drawing Sheets

THE EXACT BANK COMBINATION NUMBERS :

| | POSSIBILITIES | COMBINATIONS | | NUMBER |
|---|---|---|---|---|
| 1. | ONLY TWO 6's ONE WAY |  | 6 - 6 | TWELVE (12) |
| 2. | ONLY TWO 5's ONE WAY |  | 5 - 5 | TEN (10) |
| 3. | ONLY TWO 3's ONE WAY |  | 3 - 3 | SIX (6) |
| 4. | ANY 6 - 5 TWO WAYS |  | 6 - 5<br>5 - 6 | ELEVEN (11) |

THE EXACT PLAYER COMBINATION NUMBERS :

| | POSSIBILITIES | COMBINATIONS | | NUMBER |
|---|---|---|---|---|
| 1. | ONLY TWO 1's ONE WAY |  | 1 - 1 | TWO (2) |
| 2. | ONLY TWO 2s ONE WAY |  | 2 - 2 | FOUR (4) |
| 3. | ONLY TWO 4's ONE WAY |  | 4 - 4 | EIGHT (8) |
| 4. | ANY 1 - 2 TWO WAYS |  | 2 - 1<br>1 - 2 | THREE (3) |

ONE ROLL ACTION NUMBERS AND POSSIBILITIES :

| FIVE | SEVEN | NINE |
|---|---|---|
| 5 | 7 | 9 |

| POSSIBILITIES | COMBINATIONS | NUMBER |
|---|---|---|
| 1. ANY FIVE (5) FOUR WAYS | 1 - 4; 4 - 1 | FIVE |
| | 2 - 3; 3 - 2 | (5) |
| 2. ANY SEVEN (7) SIX WAYS | 1 - 6; 6 - 1; 2 - 5; | SEVEN |
| | 5 - 2; 3 - 4; 4 - 3; | (7) |
| 3. ANY NINE (9) FOUR WAYS | 3 - 6; 6 - 3; | NINE |
| | 4 - 5; 5 - 4 | (9) |

*FIG. 3*

| POSSIBILITIES | | COMBINATIONS | NUMBER |
|---|---|---|---|
| 1. | | 1 - 3 | FOUR (4) |
| 2. | | 3 - 1 | FOUR (4) |
| | REMINDER: NUMBER FOUR (4) MADE IN THE COMBINATION NUMBER 2-2 EFFECTS A WINNING DECISION FOR PLAYER LINE BET . . | | |
| 3. | | 1 - 5 | SIX (6) |
| 4. | | 5 - 1 | SIX (6) |
| 5. | | 2 - 4 | SIX (6) |
| 6. | | 4 - 2 | SIX (6) |
| | REMINDER: NUMBER SIX (6) MADE IN THE COMBINATION NUMBER 3-3 EFFECTS A WINNING DECISION FOR THE BANK LINE BET . . | | |
| 7. | | 2 - 6 | EIGHT (8) |
| 8. | | 6 - 2 | EIGHT (8) |
| 9. | | 3 - 5 | EIGHT (8) |
| 10. | | 5 - 3 | EIGHT (8) |
| | REMINDER: NUMBER EIGHT (8) MADE IN THE COMBINATION NUMBER 4-4 EFFECTS A WINNING DECISION FOR THE PLAYER LINE BET . . | | |
| 11. | | 4 - 6 | TEN (10) |
| 12. | | 6 - 4 | TEN (10) |
| | REMINDER: NUMBER TEN (10) MADE IN THE COMBINATION NUMBER 5-5 EFFECTS A WINNING DECISION FOR THE BANK LINE BET . . | | |

*FIG. 4*

DICE GAME HAVING DEAD-EVEN ODDS

This application relates to provisional application No. 60/073,645 filed Feb. 4, 1998.

BACKGROUND OF THE INVENTION

1. Field of the Invention

The present invention relates to games and, more particularly, to dice games.

2. Brief Description of the Prior Art

Many dice games from Craps, Casino Craps, Hi-Lo, Under and Over Seven, Bar Booth, Beat the Shake, and even the games of Monopoly and Trivia are games in which decisions are made on the roll of the dice. The object of the present invention is to modify the established practices, rules and formats of conventional Dice Craps, Bar Booth and the card game of Baccarat into a simple, reduced and combined BANK-PLAYER format. The BANK-PLAYER line bets are a dead-even chance (50-50 even money) with correct (true and exact) odds for all other bets in the instant game for a single participant shooter and any number of additional participants. These participants can, for amusement, or in most applicable cases, for chance, by a roll and/or hand of the dice, have a dead even (50-50) chance of rolling a BANK or PLAYER line bet decision that pays even money, and obtain correct (true and exact) odds on all other bets or opportunities in the instant game. In the well known dice game of Craps or Casino Craps and most other dice games, you must have two dice numbered from one to six in such a way that the spot numbers on opposite sides add to seven. All casinos maintain a standard house or retained percentage odds and always pay less than correct odds on all bets in the casino, to provide profit based on the total dollars wagered. Most of the house percentages are hidden, confusing or almost mathematically impossible for the participants to analyze or figure. In Casino Craps, the percentage returns to the house establishment are calculated into the bets and odds as the game is played, while DICE-BACCARAT has no advantage or disadvantage in percentage or odds on the BANK-PLAYER line bets, exact decision numbers or one-roll-action bets, other than the 5% laid with all bets. For example, a participant lays a $21 bet to win $20. If the laid $21 bet wins, participant wins only $20. If participant loses the bet, he loses the $21. Only on participants losing bets is the 5% commission retained, picked up by the house establishment. This is the only advantage that the house establishment has booking and/or operating the instant game.

SUMMARY OF THE INVENTION

The present invention is a method of playing a dice game between a first and a second player comprising the steps of:

(a) defining a first plurality of possible dice combinations having a first probability of occurrence;

(b) defining a second plurality of possible dice combinations having a second probability of occurrence, wherein the first probability of occurrence is equal to the second probability of occurrence and no combination in the second plurality of possible dice combinations is the same as any combination in the first plurality of possible dice combinations;

(c) allowing a first player to throw the dice and to obtain a first actual dice combination;

(d) declaring a win for the first player if the first actual dice combination is the same as one of the first plurality of possible dice combinations;

(e) declaring a win for the second player if the first actual dice combination is the same as one of the second plurality of possible dice combinations; and (f) if a win is not declared under either step (d) or step (e) then allowing the first player to throw the dice again and obtain a second actual dice combination, and if said second actual dice combination is the same as one of the first plurality of possible dice combinations declaring a win for the first player, and if said second actual dice combination is the same as one of the second plurality of possible dice combinations declaring a win for the second player.

Preferably, if in step (f) no win is declared for either the first or the second player, then step (f) is continuously repeated until a win is declared for either the first player or the second player.

This invention relates to a method of playing a dice game that has a dead-even (50-50) chance of a win-lose BANK-PLAYER bet decision for a single dice shooter and other possible participants. Other combined betting opportunities with correct (true and exact) odds for NO casino (house) establishment advantage are available except for an up-front mandate 5% commission laid with every bet and only collected on losing bets. This invention more particularly allows that a single participant (one shooter) and any number of additional participants may obtain a dead-even (50-50) win-lose bet on a BANK-PLAYER line bet decision (even money) and/or correct (true and exact) odds on all bets in the instant game DICE-BACCARAT with two six-sided conventional casino dice. The game of the present invention sometimes referred to herein as "DICE-BACCARAT" requires no mathematical percentage odds calculations as all bets have no casino retention percentage advantage: thus, no disadvantage to the participants except the 5% commission charge, laid and only collected on losing bets. Any number of participants may engage in any or all of the betting opportunities in a given hand. The shooter must make a BANK-PLAYER line bet to insure completion of that hand. At any time prior to the passing of the dice to the shooter by the dealer, any and all bets on the formatted layout are permitted up to house establishment bet limits. Any bets may also be changed, offed (no bet for that roll) or cancelled (bet and commission returned prior to shooter receiving the dice).

In Casino Craps any number may participate. In Casino Craps there is a single participant throwing the dice and he/she is called the shooter. Any number may participate but a single participant is the only person throwing the dice in the instant game DICE-BACCARAT and he/she also is called the shooter. A new participant or any other number of participants may enter the game at any time and place a bet at any time anywhere on the copyright formatted DICE-BACCARAT layout, prior to the shooter receiving the dice from the Dealer (stickman) and any throw of the dice by the shooter. All wagers must be placed before the dice are thrown; bets cannot be made while the dice are rolling. All bets made on DICE-BACCARAT are final once made (laid) and confirmed, and the dice are passed to the shooter. Obviously, the losing bets will be picked up with the required 5% commission by the house establishment. A participant may direct a Dealer to change (move); off (cancel) a bet for that one roll; or cancel any bet (bet and commission are returned) prior to the shooter receiving the dice. Once the shooter receives the dice, all bets stand until prior to the next throwing of the dice (stickman passes dice to shooter). In Casino Craps, the dice pass after a seven (7) out, from participant to participant, to the left, clockwise. In DICE-BACCARAT, after a Player dice combination number decision is thrown in a hand, the dice pass to the next participant to the left, clockwise. The shooter/participant, at his option, may continue as the shooter as long as the previous completed hand was a BANK dice combination number decision. Any shooter may pass the dice in Casino Craps prior to a come-out, but never in the middle of a hand. A hand in Casino Craps and DICE-BACCARAT is come-out (start of a new decision) through completion of a decision on the line bets. In DICE-BACCARAT, every shot of the dice is a come-out, therefore, a shooter may cancel his line bet at any time prior to receiving the dice from the Dealer, which causes the dice to pass to the next shooter.

BRIEF DESCRIPTION OF THE DRAWINGS

The invention is further described with reference to the accompanying to the accompanying drawings in which:

FIG. 3 is a schematic chart showing one roll action numbers and possibilities; and FIG. 4 is a schematic chart showing various other possible combination numbers that are non-betting and have no effect on hand decisions.

DETAILED DESCRIPTION OF THE PREFERRED EMBODIMENT

Figure 1:
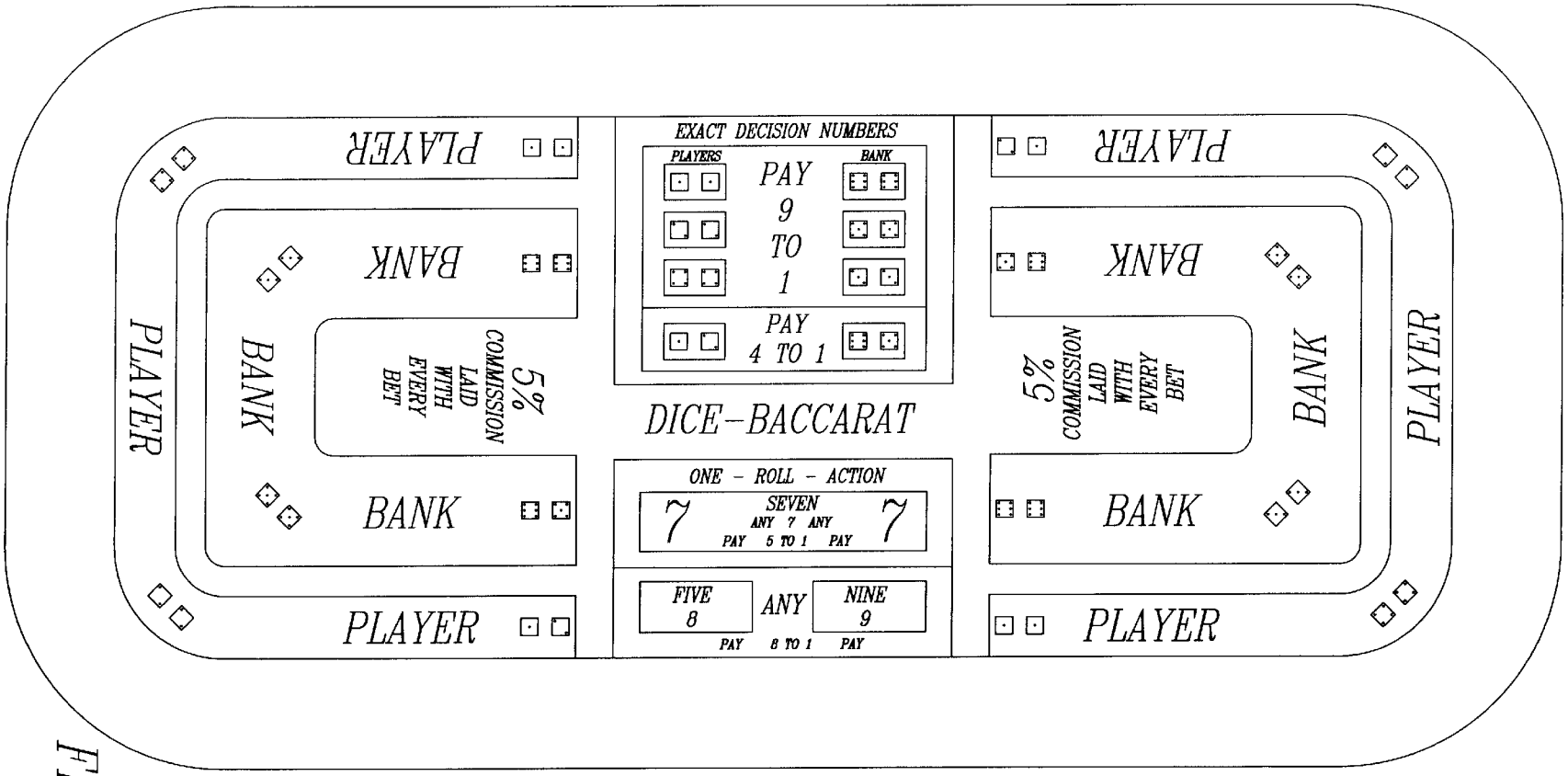
FIG. 1 is a top plan view of a formatted layout used in the play of the game in the present invention.
Figure 2:
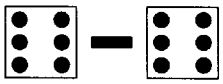
FIG. 2 is a schematic chart showing combinations that effectuate the bank-player line bet decisions.
Figure 2:
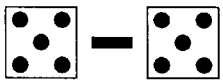
Figure 2:
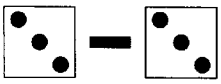
Figure 2:
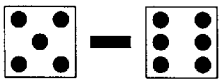
Figure 2:
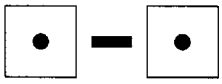
Figure 2:
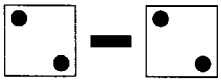
Figure 2:
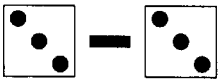
Figure 2:
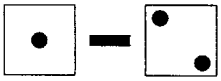

The present invention provides a method for a single shooter to play a dice game with a dead-even (50-50) chance of effectuating a bank-player decision, in conjunction with correct odds on other bets. It also allows any number of additional participants to also make dead-even and correct bets on that shooter's hand (throw of the dice) with a 5% commission laid with each bet and only collected on losing bets. The following steps occur: a set of conventional dice are selected and with a single closed fist, the dice are shaken and then thrown across a conventional dice-type table so that the dice bounce (hit) the opposite back board and come to rest on the table. The two most skyward numbers are the thrown numbers and/or combinations for that shot. There are assigned values or combination numbers for bank-player decisions that effectuate the end of a hand (come-out through a decision combination number thrown. The layout of the game has 4 exact bank combination numbers and 4 exact player combination numbers (line bets) which any one of these exact bank-player combination numbers must be thrown to effectuate the end of a hand. The shooter must bet a bank or player decision to insure the completion of his hand and any additional participants have made on the formatted layout shown in FIG. 1.

These 8 numbers have 10 possibilities and/or combination ways that only effectuate a bank-player, dead even win-lose decision on the hand and the exact decision numbers. Line bet winning odds are even money. The mandatory 5% commission laid with every bet is only collected on losing bets.

The exact decision number pays correct odds as listed on the formatted layout. This bet is actually picking the exact banker or player decision combination number that will decide that hand the bet is made in. Both bank-player line bets and the exact decision numbers are effectuated by the same bank-player combination number.

There are 3 remaining, optional betting numbers left on the dice, 5-7-9 to complete the balance on eleven possible numbers 2 through 12 to be thrown with the dice. The numbers 5-7-9 can only be bet on one roll action. They have correct odds with no house percentage advantage except the required 5% commission placed with every bet and only collected on a losing bet. One roll action or a one roll bet means a bet on that one roll and applies only to one of the three numbers 5-7-9 that are bet singularly. There are 14 possible combinations to make any of the 3 one roll decision numbers. Participants may bet a one or all, singular and separate of the three numbers 5-7-9 and must have that one exact number thrown in any combination to have a winning bet in one roll action. Any other number thrown on the dice effectuates a losing bet for that one roll action number.

The eleven possible numbers 2 through 12 are all represented in the game Dice-Baccarat and may be bet in some way and/or number combination even though 12 non-betting, no effect combination numbers exist. After listing the correct odds for the betting numbers and/or combination of numbers, the non-betting combination number will be expanded.

The bank-player decision combination numbers are ace and deuce, which can be thrown two ways; the one and two that can be thrown two ways; the six and five, which can be thrown two ways; and the 6 other combination numbers that can only be thrown one way: 1-1, 2-2, 3-3, 4-4, 5-5, or 6-6 for six ways, or a total of 10 possibilities for a bank-player decision on the dice. These 8 called numbers 2 through 12 can only be made in one of the exact bank-player combinations for that called number to effectuate a decision for the bank or player side of the line bets. The 4 bank combination number possibilities 6-6, 5-5, 3-3 and 6-5; and the player combination number possibilities 1-1, 2-2, 4-4 and 1-2 create a bank-player dead even win or lose decision that pays even money. In the 4 bank combination numbers and the 4 player combination numbers, 3 numbers in each side can only be made one way and one combination. One number on each side can be made two ways and in two possible combinations. These equal combinations of bank or player effectuate the dead even chance in Dice-Baccarat.

Additionally, any of the 8 combination numbers can be bet as/or actually picking the exact decision number to be thrown in a given hand which will pay correct odds for the exact deciding number combination for that hand. The numbers that can be made only one way: 1-1, 2-2, 3-3, 4-4, 5-5 and 6-6 that effect a bank-player decision pay nine to one if that exact number is the bank or player decision number thrown for that hand. The 1-2 or the 6-5 combinations pay four to one which are correct odds if bet as that exact number and is thrown as the decision combination number for that hand.

To make an exact bet on any 5-7-9 , the player is paid correct odds for throwing that exact number when bet on One Roll Action; 5 to 1 on any 7 thrown; and on any 5 or any 9, the odds of 8 to 1 are paid when the exact number is bet in One Roll Action. One Roll Action bets are won or lost on the next single roll after the bet is placed. The aforementioned correct odds are paid on winning bets made in the game DICE-BACCARAT. There may be a mandatory 5% commission charge laid with all bets and only collected on losing bets. All winning bets retain the laid commission placed with the bet.

The remaining 12 possible combination numbers that are non-betting and have no effect on the hand decision are shown in FIG. 4. These 12 possibilities of actual combination numbers thrown on a pair of dice in DICE-BACCARAT have no assigned or betting value and only effectuate the One Roll Action numbers in the following manner. If any of the non-betting, no effect numbers are thrown, they actually do effectuate a losing decision for the One Roll Action numbers 5-7-9.

This game could be played by use of electronic video apparatus in which the 36 combination numbers on the dice could be random numbers generated and displayed for results with the bet taking a predetermined percentage of the dollar play in the program. The payout or generation of the correct number of winning and losing bets could retain a predetermined upfront percentage commission for the house.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of playing a dice game between a first and a second player comprising the steps of:

(a) defining a first plurality of possible dice combinations having a first probability of occurrence;

(b) defining a second plurality of possible dice combinations having a second probability of occurrence, wherein the first probability of occurrence is equal to the second probability of occurrence and no combination in the second plurality of possible dice combinations is the same as any combination in the first plurality of possible dice combinations;

(c) allowing a first player to throw the dice and to obtain a first actual dice combination;

(d) declaring a win for the first player if the first actual dice combination is the same as one of the first plurality of possible dice combinations;

(e) declaring a win for the second player if the first actual dice combination is the same as one of the second plurality of possible dice combinations; and (f) if a win is not declared under either step (d) or step (e) then allowing the first player to throw the dice again and obtain a second actual dice combination, and if said second actual dice combination is the same as one of the first plurality of possible dice combinations declaring a win for the first player, and if said second actual dice combination is the same as one of the second plurality of possible dice combinations declaring a win for the second player.

2. The method of claim 1 wherein if in step (f) no win is declared for either the first or the second player, then performing the additional step of repeating step (f) until a win is declared for either the first player or the second player.

3. The method of claim 2 wherein the first plurality of possible dice combinations comprises a 1 and a 1, a 2 and a 2, a 4 and a 4, and a 1 and a 2.

4. The method of claim 3 wherein the second plurality of possible dice combinations comprises a 6 and a 6, a 5 and a 5, a 3 and a 3, and a 5 and a 6.

5. The method of claim 1 wherein bets are laid and a commission is paid on losing bets.

6. A method of playing a dice game between a first and a second player comprising the steps of:

(a) defining a first plurality of possible dice combinations having a first probability of occurrence;

(b) defining a second plurality of possible dice combinations having a second probability of occurrence, wherein the first probability of occurrence is equal to the second probability of occurrence and no combination in the second plurality of possible dice combinations is the same as any combination in the first plurality of possible dice combinations;

(c) throwing the dice to obtain a first actual dice combination;

(d) declaring a win for the first player if the first actual dice combination is the same as one of the first plurality of possible dice combinations;

(e) declaring a win for the second player if the first actual dice combination is the same as one of the second plurality of possible dice combinations; and (f) if a win is not declared under either step (d) or step (e) then throwing the dice again to obtain a second actual dice combination, and if said second actual dice combination is the same as one of the first plurality of possible dice combinations declaring a win for the first player, and if said second actual dice combination is the same as one of the second plurality of possible dice combinations declaring a win for the second player.

7. The method of claim 6 wherein if in step (f) no win is declared for either the first or the second player, then performing the additional step of repeating step (f) until a win is declared for either the first player or the second player.

8. The method of claim 7 wherein the first plurality of possible dice combinations comprises a 1 and a 1, a 2 and a 2, a 4 and a 4, and a 1 and a 2.

9. The method of claim 8 wherein the second plurality of possible dice combinations comprises a 6 and a 6, a 5 and a 5, a 3 and a 3, and a 5 and a 6.

10. The method of claim 6 wherein bets are laid and a commission is paid on losing bets.

* * * * *